US010781643B2

(12) United States Patent
Bao et al.

(10) Patent No.: US 10,781,643 B2
(45) Date of Patent: Sep. 22, 2020

(54) CUTTING ELEMENTS FORMED FROM COMBINATIONS OF MATERIALS AND BITS INCORPORATING THE SAME

(71) Applicant: Smith International, Inc., Houston, TX (US)

(72) Inventors: Yahua Bao, Orem, UT (US); Yi Fang, Orem, UT (US); Haibo Zhang, Lindon, UT (US); John Daniel Belnap, Lindon, UT (US); Youhe Zhang, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 107 days.

(21) Appl. No.: 16/061,097

(22) PCT Filed: Nov. 24, 2016

(86) PCT No.: PCT/US2016/063709

§ 371 (c)(1),
(2) Date: Jun. 11, 2018

(87) PCT Pub. No.: WO2017/105804

PCT Pub. Date: Jun. 22, 2017

(65) Prior Publication Data

US 2018/0363383 A1 Dec. 20, 2018

Related U.S. Application Data

(60) Provisional application No. 62/267,194, filed on Dec. 14, 2015.

(51) Int. Cl.

| | |
|---|---|
| ***E21B 10/55*** | (2006.01) |
| ***E21B 10/56*** | (2006.01) |
| *E21B 10/567* | (2006.01) |

(52) U.S. Cl.
CPC ..... *E21B 10/55* (2013.01); *E21B 10/56* (2013.01); *E21B 10/567* (2013.01)

(58) Field of Classification Search
CPC ..... E21B 10/55; E21B 10/56; E21B 10/5673; E21B 10/5735; E21B 10/567; E21B 2010/565
See application file for complete search history.

(56) References Cited

U.S. PATENT DOCUMENTS 4,440,246 A * 4/1984 Jurgens ..... E21B 10/46 175/329
6,131,678 A 10/2000 Griffin
(Continued)

FOREIGN PATENT DOCUMENTS

CN 204729011 U 10/2015
WO 2013170083 A1 11/2013

OTHER PUBLICATIONS

First Office Action and Search Report issued in Chinese Patent application 201680073234.6 dated Aug. 2, 2019, 23 pages.
(Continued)

*Primary Examiner* — Yong-Suk Ro

(57) ABSTRACT

A cutting element has an ultrahard layer on a substrate, the ultrahard layer having a non-planar working surface. The non-planar working surface is formed from a first region and a second region, where the first region encompasses at least a cutting edge or tip of the cutting element and has a differing composition than the second region.

21 Claims, 5 Drawing Sheets

(56) References Cited

U.S. PATENT DOCUMENTS

| | | | |
|---|---|---|---|
| 6,227,318 | B1 | 5/2001 | Siracki |
| 8,069,937 | B2 | 12/2011 | Mukhopadhyay et al. |
| 8,216,677 | B2 | 7/2012 | Mukhopadhyay et al. |
| 8,440,303 | B2 | 5/2013 | Mukhopadhyay et al. |
| 9,091,131 | B2 | 7/2015 | Yu et al. |
| 2005/0269139 | A1 | 12/2005 | Shen et al. |
| 2010/0263939 | A1 | 10/2010 | Hall et al. |
| 2012/0103699 | A1 | 5/2012 | Yu et al. |
| 2012/0199401 | A1 | 8/2012 | Zhang et al. |
| 2013/0344309 | A1 | 12/2013 | Adia et al. |
| 2014/0261545 | A1* | 9/2014 | Azar et al. ..... E21B 10/5673 175/430 |

OTHER PUBLICATIONS

International Search Report and Written Opinion issued in International Patent application PCT/US2016/063709 dated Mar. 9, 2017. 15 pages.

International Preliminary Report on Patentability issued in International Patent application PCT/US2016/063709 dated Jun. 28, 2018, 12 pages.

Second Office Action issued in Chinese Patent Application 201680073234.6 dated Apr. 2, 2020, 13 pages.

* cited by examiner

CUTTING ELEMENTS FORMED FROM COMBINATIONS OF MATERIALS AND BITS INCORPORATING THE SAME

BACKGROUND

There are several types of downhole cutting tools, such as drill bits, including roller cone bits, hammer bits, and drag bits, reamers and milling tools. Roller cone rock bits include a bit body adapted to be coupled to a rotatable drill string and include at least one "cone" that is rotatably mounted to a cantilevered shaft or journal. Each roller cone in turn supports a plurality of cutting elements that cut and/or crush the wall or floor of the borehole and thus advance the bit. The cutting elements, including inserts or milled teeth, contact the formation during drilling. Hammer bits generally include a one piece body having a crown. The crown includes inserts pressed therein for being cyclically "hammered" and rotated against the earth formation being drilled.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultrahard cutting surface layer or "table" (generally made of polycrystalline diamond material or polycrystalline boron nitride material) deposited onto or otherwise bonded to a substrate are known in the art as polycrystalline diamond compact ("PDC") bits.

An example of a drag bit having a plurality of cutting elements with ultrahard working surfaces is shown in FIG. 1. The drill bit 100 includes a bit body 110 having a threaded upper pin end 111 and a cutting end 115. The cutting end 115 generally includes a plurality of ribs or blades 120 arranged about the rotational axis (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired backrake angle and siderake angle against a formation to be drilled.

FIG. 2 shows an example of a cutting element 150, wherein the cutting element 150 has a cylindrical cemented carbide substrate 152 having an end face or upper surface referred to herein as a substrate interface surface 154. An ultrahard material layer 156, also referred to as a cutting layer, has a top surface 157, also referred to as a working surface, a cutting edge 158 formed around the top surface, and a bottom surface, referred to herein as an ultrahard material layer interface surface 159. The ultrahard material layer 156 may be a polycrystalline diamond or polycrystalline cubic boron nitride layer. The ultrahard material layer interface surface 159 is bonded to the substrate interface surface 154 to form a planar interface between the substrate 152 and ultrahard material layer 156.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting element including: a substrate; and an ultrahard layer on the substrate, the ultrahard layer having a non-planar working surface, the non-planar working surface being formed from a first region and a second region, the first region, encompassing at least a cutting edge or tip of the cutting element and having a differing composition than the second region.

In another aspect, embodiments disclosed herein relate to a method for making a cutting element including: forming an ultrahard layer with a non-planar working surface having a first region and a second region having a differing composition from the first region, the first region forming a cutting edge or tip of the non-planar working surface; and attaching a substrate to the ultrahard layer by high temperature high pressure processing.

In yet another aspect, embodiments disclosed herein relate to a downhole cutting tool, including: a tool body; and at least one cutting element attached to the tool body, wherein the cutting element comprises a substrate and an ultrahard layer on the substrate, the ultrahard layer having a non-planar working surface, the non-planar working surface being formed from a first region and a second region, the first region, encompassing at least a cutting edge or tip of the cutting element and having a differing composition than the second region.

Other aspects and advantages of the claimed subject matter will be apparent from the following description and the appended claims.

DETAILED DESCRIPTION

In one aspect, embodiments disclosed herein relate to cutting elements having non-planar working surfaces and to cutting tools having such cutting elements attached thereto. In particular, embodiments disclosed herein relate to a cutting element having a working surface having a first region, encompassing at least a cutting edge or tip of the cutting element, and a second region having a differing composition than the composition of the first region.

Whereas a conventional PCD cutting element includes an ultrahard layer that has a substantially homogenous composition throughout the ultrahard layer or at least at the working surface, a cutting element of the present disclosure includes an ultrahard layer that has a first region of the working surface which is compositionally distinct from a second region of the working surface of the ultrahard layer. As used herein, "working surface" is defined as the surface that is opposite a base of the cutting element (i.e., or is a top surface of the cutting element) and which engages the formation to be cut. In one or more embodiments, the working surface of the ultrahard layer may be substantially planar, or in one or more embodiments, the working surface may be non-planar. While the specific geometry of a non-planar working surface is not intended to be particularly restricted, examples of such cutting elements having a non-planar working or top surface may include, for example, a substantially hyperbolic paraboloid (saddle) shape or a parabolic cylinder shape, where the crest or apex of the cutting element extends across substantially the entire diameter of the cutting element.

Figure 3:
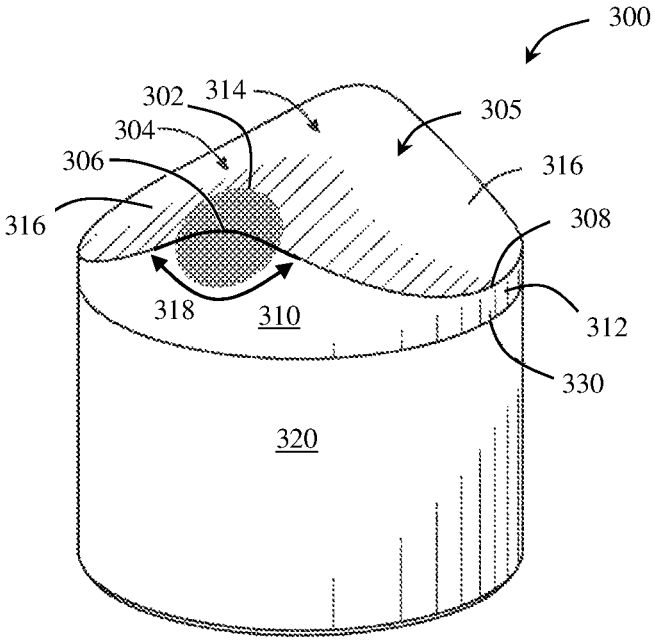
FIG. 3 is an embodiment of a cutting element with a plurality of compositional regions.

For example, a cutting element 300 with a plurality of compositional regions is shown in FIG. 3. Particularly, the cutting element 300 has a substrate 320 and an ultrahard layer 310 disposed on the substrate 320 at an interface 330. As illustrated, ultrahard layer 310 has a working surface 305 having a non-planar geometry. Peripheral edge 308 surrounds the non-planar working surface 304 at the intersection between the non-planar working surface 304 and a cylindrical side surface 312. A portion of the peripheral edge 308, referred to as cutting edge 306, is the portion of the ultrahard layer 310 that performs substantially all of the formation cutting during the advancement of a drill bit in an earthen formation. In this illustrated embodiment, the working surface has a substantially parabolic cylinder shape. Specifically, the working surface has a crest 314 that extends from the cutting edge 306 across the diameter of the cutting element to the other side (but may be greater or less than the diameter in some embodiments) and sidewalls 316 extending laterally and axially away from the crest 314. As shown, the crest 314 has a convex cross-sectional shape (viewed along a plane perpendicular to crest length across the diameter of the ultrahard layer), where the uppermost point of the crest has a radius of curvature that transitions to sidewall surfaces 316 at an angle 318. According to embodiments of the present disclosure, a cutting element top surface may have a cutting crest with a radius of curvature ranging from 0.02 inches (0.51 mm) to 1.00 inches (25.4 mm), or in another embodiment, from 0.06 inches (1.52 mm) to 0.30 inches (7.62 mm). Angle 318 may range, for example, from 90 to 160 degrees.

As illustrated, the non-planar working surface 305 is formed from a plurality of distinct compositional regions. In this illustrated embodiment, at least a cutting edge 306 of the working surface 305 and a portion of the crest 314 of the ultrahard layer 310 may be included within a single compositionally distinct first region 302. Further, in FIG. 3 it is shown that a second region 304 (which may be the remainder of the working surface 305 and peripheral edge 308 of the ultrahard layer 310 that does not include the cutting edge 306) may be compositionally distinct from the first region that includes at least a cutting edge of the working surface 305 of the ultrahard material layer 310. Further, this first region 302 also extends along a portion of cylindrical side surface 312.

In one or more embodiments, the width of the first region 302 may be up to about 8 mm. In one or more embodiments, the depth of the first region 302 on the outer diameter may be up to about 2.5 mm. In one or more embodiments, the length of the first region 302 along the crest 314 may be up to about 4.5 mm. In one or more embodiments, each dimension defining the first region 302 may be up to two times the amount (i.e., width, depth, or length) of the cutting element 300 that interacts with the formation at a maximum depth of cut expected for a cutting element.

Figure 4:
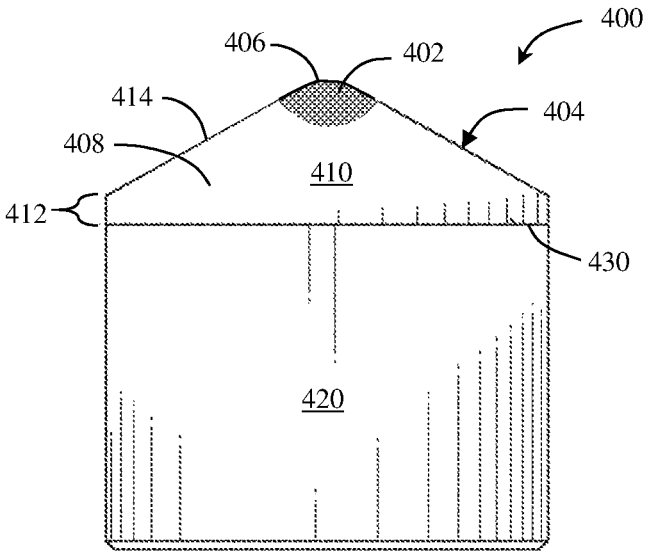
FIG. 4 is an embodiment of a cutting element with a non-planar working surface having two compositionally distinct regions.

FIG. 4 presents another prospective embodiment of a cutting element 400 with a non-planar working surface. More specifically, FIG. 4 depicts a side profile view of a conical cutting element 400 that has two compositionally distinct regions. As used herein, the term "conical cutting elements" refers to cutting elements having a generally conical cutting end (including either right cones or oblique cones) that terminate in a rounded apex. Unlike geometric cones that terminate at a sharp point apex, the conical cutting elements of the present disclosure possess a rounded apex having curvature between the conical sidewall and the point of the apex. However, it is also envisioned that other "pointed" cutting elements may be used, including those with convex or concave sidewalls that terminate in a rounded apex 406, or cutting elements with non-rounded apexes, such as truncated apexes, may also be used. The cutting element 400 has a substrate 420 and an ultrahard layer 410 on the substrate 420 at an interface 430. Ultrahard layer 410 has a working surface 404 with a non-planar top surface geometry. In this particular embodiment, at least the rounded apex 406 (the cutting tip or region having curvature in the axial direction) of the working surface 404 of the ultrahard layer 410 may be included in a single compositionally distinct first region 402. In one or more embodiments, the first region 402 may also include a portion of, but not all of, the sidewall 414. Further, in FIG. 4 it is shown that a second region 408 of the working surface 404 of the ultrahard layer 410 that does not include the cutting tip 406 may be compositionally distinct from the region that includes at least the cutting tip 406 of the working surface 404 of the ultrahard material layer 410. In an embodiment, second region 408 may include the remainder of sidewall 414. In an embodiment, second region 408 also includes a cylindrical side surface 412 that extends between the sidewall of the non-planar working surface 404 and substrate 420.

The first and second regions, while compositionally distinct, may both be formed of ultrahard materials, such as diamond containing materials, including polycrystalline diamond, which may be made from natural or synthetic diamond particles. Conventional polycrystalline diamond is formed from diamond particles that are sintered together using a Group VIII catalyst metal (such as cobalt, iron, and/or nickel). Upon sintering at high pressure, high temperature conditions, the diamond particles form an intercrystalline skeleton of bonded together diamond grains with interstitial regions therebetween in which the catalyst resides. In one or more embodiments, a conventional polycrystalline diamond may be used to form one of the regions of the ultrahard layer, while in one or more different embodiments, a non-conventional polycrystalline diamond material may be used.

For example, in one or more embodiments, the first region including at least the cutting edge or tip of the working surface of the ultrahard layer may be formed from diamond particles that are sintered to form a polycrystalline diamond (PCD) material, and subsequently leached to remove the catalyst material from the interstitial regions to form a first region of thermally stable polycrystalline diamond that may be used in combination with a second region that is conventional polycrystalline diamond. That is, the cutting edge or tip (discussed above) of the non-planar working surface may be thermally stable (substantially free of a Group VIII catalyst) and the remainder of the non-planar working surface may be conventional polycrystalline diamond (having Group VIII catalyst still residing in the interstitial regions).

In one or more embodiments, the compositional difference between the first and second region may be varying particle sizes of the diamond particles used to form the ultrahard layer. For example, the diamond particles used to form the first region (including at least the cutting edge or tip) may be fine sized particles, such as particles having an average particle size of less than about 20 micrometers. In one or more embodiments, the first region may be formed from diamond particles having an average particle size with a lower limit of any of 1, 5, or 10 microns and an upper limit of any of 10, 15, or 20 microns, where any lower limit may be used in combination with any upper limit. When the first region is formed from such fine diamond particles, it may be used in combination with a second region formed of diamond particles having a larger average particle size, such as from about 20 micrometers to about 100 micrometers, thereby rendering the two regions compositionally distinct. However, in one or more embodiments, the first region may be formed from diamond particles having a larger average particle size than the second region. In yet another embodiment, the first region and second region have the same average particle size, but differ compositionally in other ways.

In one or more embodiments, the first region including at least a cutting edge or tip of the working surface of the ultrahard layer may be comprised of sintered diamond particles formed with a magnesium carbonate binder material, while the second region may be formed from a calcium carbonate binder material, or vice versa. In one or more embodiments, the magnesium carbonate binder material in the first region may be limited to less than about 3 percent by volume of the ultrahard material in the region. The lower limit of the magnesium carbonate binder material may be any of 0.1 percent, 0.5 percent, 1.0 percent, or 2.0 percent by volume of the ultrahard material in the region. In the second region, the calcium carbonate binder material may be present in an amount that is at least about 3 percent by volume of the ultrahard material in the region. For example, in some embodiments the amount of calcium carbonate binder material in the second region may be up to 4.0 percent, up to 5.0 percent, up to 6.0 percent, up to 7.0 percent, up to 8.0 percent, up to 9.0 percent or up to 10.0 percent calcium carbonate binder by volume of the ultrahard material in the region.

In various embodiments, the first region, the region that includes the portion of the working surface that includes the cutting edge and/or cutting tip of the non-planar cutting element, may be more wear resistant than the second region, i.e., the remaining portion of the working surface. For example, such a more wear resistant material may include polycrystalline diamond formed from fine particle sizes (as compared to a second region formed from diamond particles of a larger average particle size), formed from a magnesium carbonate binder material (as compared to a second region formed from calcium carbonate binder material), or may be substantially free from a Group VIII metal (as compared to a second region of conventional PCD with a Group VIII metal). For example, according to embodiments presented herein, the first region (including at least a cutting edge or tip of the working surface of the ultrahard layer) may be at least about 50 percent more wear resistant than the second region of the ultrahard layer (formed from the working surface other than the cutting edge or tip of the upper surface of the ultrahard layer).

In contrast, the second region may be more impact resistant than the first region. For example, in some embodiments, the fracture toughness of the second region may be at least 10% higher than that of the first region. In one or more embodiments, the fracture toughness of the second region may be about 20% higher than that of the first region.

Formation of a Cutting Element

As mentioned above, polycrystalline diamond ("PCD") materials may be formed by subjecting diamond particles in the presence of a suitable solvent metal catalyst material or carbonate binder material to processing conditions of high pressure/high temperature (HPHT), where the solvent metal catalyst or carbonate binder promotes desired intercrystalline diamond-to-diamond bonding between the particles, thereby forming a PCD structure. The catalyst/binder material, e.g., cobalt or an alkaline earth carbonate, used to facilitate the diamond-to-diamond bonding that develops during the sintering process, is dispersed within the interstitial regions formed within the diamond matrix first phase. The term "particle" refers to the powder employed prior to sintering a superabrasive material, while the term "grain" refers to discernable superabrasive regions subsequent to sintering, as known and as determined in the art.

Solvent metal catalyst materials may facilitate diamond intercrystalline bonding and bonding of PCD layers to each other and to an underlying substrate. Solvent catalyst materials generally used for forming PCD include metals from Group VIII of the Periodic table, such as cobalt, iron, or nickel and/or mixtures or alloys thereof, with cobalt being the most common. In carbonate-based PCD materials of the present disclosure, the inclusion of a transition metal catalyst is not necessary for formation of diamond-to-diamond bonds, and thus the carbonate-based PCD bodies may not contain such materials. However, in some embodiments, a carbonate-based polycrystalline diamond body may include small amounts of a transition metal catalyst, such as cobalt, in addition to the diamond and carbonate material, due to infiltration during sintering and/or by premixing the transition metal with the diamond and carbonate materials. In such embodiments, carbonate-based PCD having small amounts of transition metal may include, for example, between 0 and 4 percent by weight of the transition metal, between 0 and 2 percent by weight of the transition metal, or between 0 and 1 percent by weight of the transition metal.

The catalyst/binder material used to facilitate diamond-to-diamond bonding can be provided generally in two ways. The catalyst/binder can be provided in the form of a raw material powder that is pre-mixed with the diamond powder prior to sintering, or in some cases, the catalyst/binder can be provided by infiltration into the diamond material (during high temperature/high pressure processing) from an underlying substrate material to which the final PCD material is to be bonded. After the catalyst/binder material has facilitated the diamond-to-diamond bonding, the catalyst/binder material is generally distributed throughout the diamond matrix within interstitial regions formed between the bonded diamond grains.

The diamond mixtures may be subjected to high pressure high temperature conditions, such as pressures greater than 4 GPa and temperatures greater than 1200° C. For example, in some embodiments, the layers may be subjected to a pressure of 5.5-8 GPa and a temperature of greater than 1400° C., or when carbonates are used, to higher temperatures and pressures, such as pressures greater than 6 GPa (such as up to 10 GPa) and temperatures greater than 1700° C. or even 2000° C.

In some embodiments, distinct regions of the ultrahard PCD layer may comprise from 85 to 95% by volume diamond and a remaining amount of the solvent catalyst or binder material. However, while higher metal and binder content typically increases the toughness of the resulting PCD material, higher metal and binder content also decreases the PCD material hardness, thus limiting the flexibility of being able to provide PCD coatings having desired levels of both hardness and toughness. Additionally, when variables are selected to increase the hardness of the PCD material, typically brittleness also increases, thereby reducing the toughness of the PCD material.

As mentioned above, in one or more embodiments, a cutting element according to the present disclosure may be made by high pressure/high temperature (HPHT) processing. In some embodiments, the first region and the second region may be formed by assembling together a first material mixture and a second material mixture having a differing composition (in some way, such as chemistry, particle size, etc.) than the composition of the first material mixture. The first material mixture may be used to create a first region of the ultrahard layer, while the second material mixture may be used to create the second layer of the ultrahard layer. In one or more embodiments, the first material mixture and the second material mixture may be assembled so that they form a first region and a second region that are in physical contact at an interface. The interface between the two regions may be a planar interface or a non-planar interface.

To form the ultrahard layer the first material mixture and the second material mixture, once assembled adjacent to one another, may be subjected to a HPHT processing conditions, such as those discussed above, to form the polycrystalline structures as well as physically bond the regions together.

However, in one or more embodiments, the first material mixture may be assembled into a first region and subjected to a HPHT processing condition before being assembled with the second material mixture to form a sintered first region. After forming the sintered first region, the second material mixture may be assembled into a second region adjacent to the first region and the first region and the second region may be physically bonded together during a subsequent HPHT processing condition to form an ultrahard layer having two regions with distinct compositions.

It is also envisioned that the substrate is attached to the ultrahard layer during the HPHT processing that forms the ultrahard layer having two compositionally distinct regions or at least during the HPHT processing in which the two distinct regions are physically bonded together. Thus, in some embodiments, the same HPHT processing condition may be used to both: (1) form the ultrahard layer having two regions with distinct compositions and (2) attach a substrate to the ultrahard layer.

However, it is also envisioned that the ultrahard layer having two compositionally distinct regions so formed may then be placed adjacent to a substrate and attached to a substrate by a subsequent HPHT processing condition. Such attachment methods may include disposing an ultrahard layer having two compositionally distinct regions in a sintering container, placing a substrate in the sintering container, and subjecting the sintering container and the contents therein to HPHT conditions (similar to those described above for the formation of the ultrahard layer) to form a ultrahard layer having two compositionally distinct regions bonded to the substrate.

Figure 5:
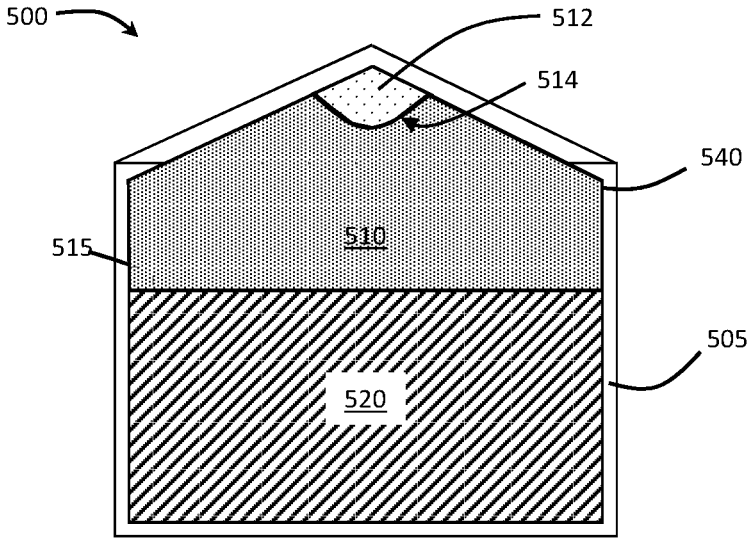
FIG. 5 shows an assembly for sintering an ultrahard layer having two compositionally distinct regions to a substrate.

According to methods of the present disclosure of sintering an ultrahard layer having two compositionally distinct regions on a substrate, a substrate may be assembled directly adjacent to an ultrahard material having two compositionally distinct regions in a sintering container prior to subjecting the sintering container and the contents therein to HPHT conditions to form an ultrahard layer having two compositionally distinct regions bonded to the substrate. For example, FIG. 5 shows an assembly for sintering an ultrahard material having two compositionally distinct regions to a substrate. The assembly 500 includes an ultrahard material having two compositionally distinct regions (i.e, regions 510 and 512) and a substrate 520 placed in a sintering container 505, wherein one of the compositionally distinct regions is placed adjacent to the substrate 520 at an interface surface 515. The interface surface 515 shown in FIG. 5 is planar; however, a non-planar interface may be formed between the PCD material and the substrate in other embodiments. Further, in some embodiments the sintering container 505 may be shaped to mold the working surface of the ultrahard layer into the desired non-planar geometry, as is shown in FIG. 5, or the non-planar geometry may be formed by post-sintering processing.

The substrate 520 may be formed of a cemented carbide material, such as cemented tungsten carbide containing a metal binder such as cobalt or other metal selected from Group VIII of the Periodic Table, or other substrate materials known in the art of cutting tools. Further, the substrate 520 may be provided in the sintering container as a preformed substrate or as a powdered substrate material mixture. For example, according to some embodiments, a mixture of carbide powder and cobalt powder may be placed in the sintering container to form the substrate. According to other embodiments, a substrate may be preformed from a carbide material and a binder such as by sintering, pressing to form a green compact, hot pressing, or other methods known in the art.

The ultrahard material having two compositionally distinct regions (i.e., regions 510 and 512) may be provided as a preformed body, or as a powdered mixture within the sintering container 505 and adjacent to the substrate 520. In embodiments using a preformed ultrahard layer having two compositionally distinct regions, the ultrahard layer having two compositionally distinct regions may be formed by sintering two compositionally distinct powder material mixtures that are assembled into two distinct regions, such as described above, under HPHT conditions, such as pressures greater than 4 GPa and temperatures greater than 1,200° C. The two compositionally distinct regions (i.e., regions 510 and 512) may be in physical contact at an ultrahard interface 514. In one or more embodiments, one or both of the compositionally distinct regions may be sintered under HPHT conditions separately from the other compositionally distinct region, after which the two compositionally distinct regions may be attached at an ultrahard interface 514 by a subsequent HPHT condition. In embodiments connecting two compositionally distinct powdered material mixtures with a substrate in a single HPHT sintering condition, the two compositionally distinct powdered material mixtures may be assembled into two distinct regions within the sintering container 505 prior to the HPHT sintering, with the two compositionally distinct regions (i.e., regions 510 and 512) in physical contact at an ultrahard interface 514 and one compositionally distinct region (e.g., 510 in FIG. 5) adjacent to the preformed substrate or powdered material that will form the substrate upon HPHT sintering.

Figure 1:
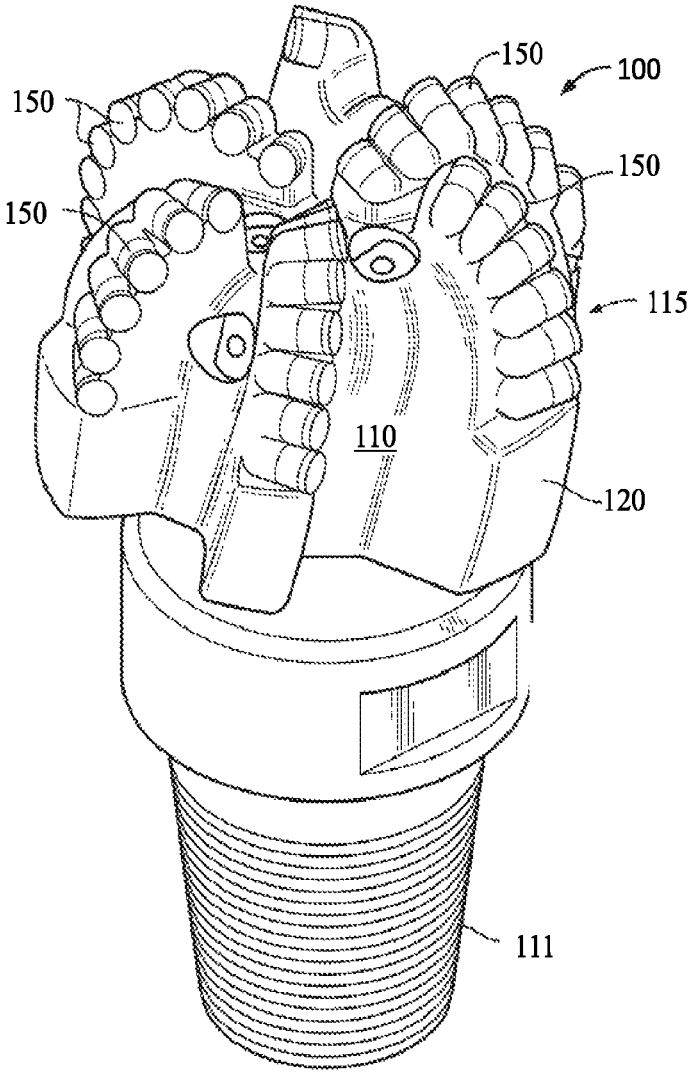
FIG. 1 is a fixed cutter drill bit.
Figure 2:
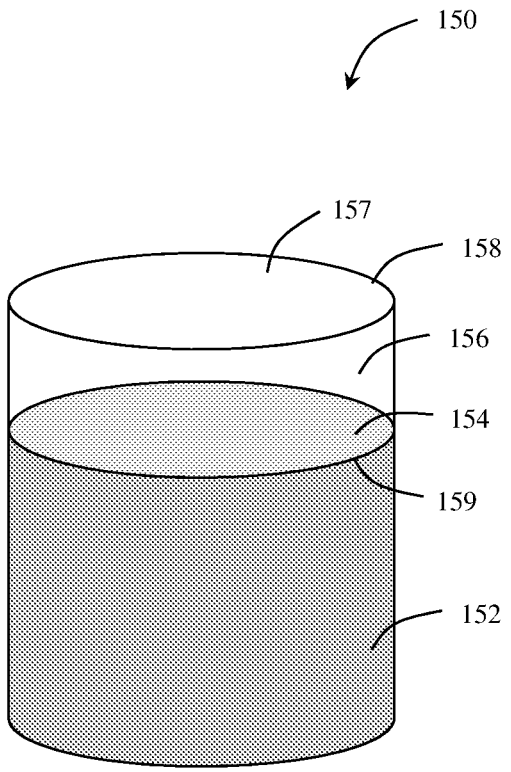
FIG. 2 is a conventional cutter for fixed cutter drill bit.
Figure 6:
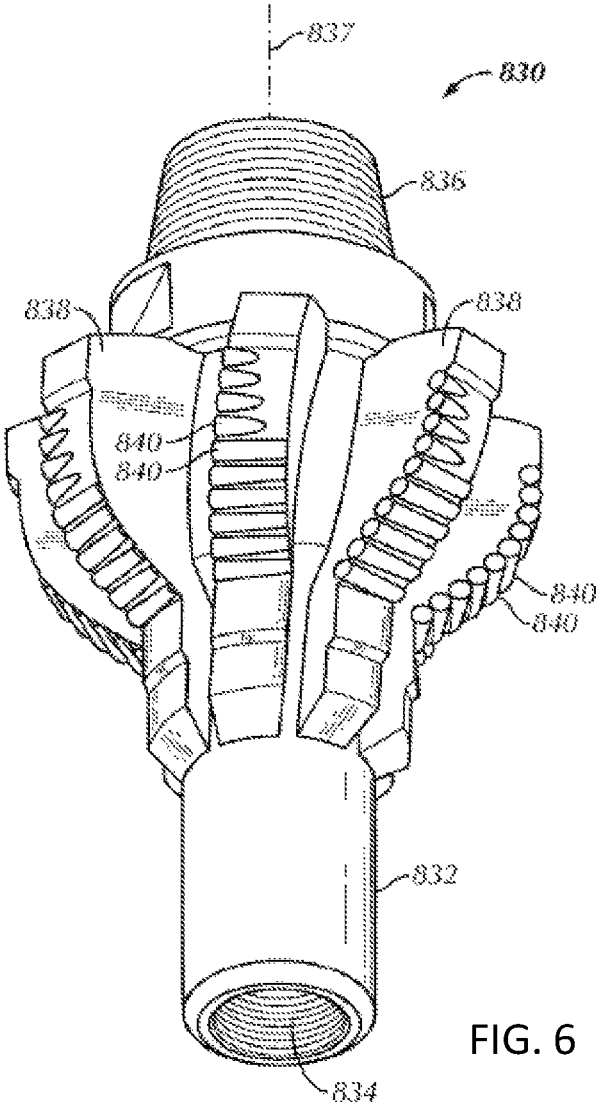
FIG. 6 shows a general configuration of a hole opener.

While the cutting elements of the present disclosure may be used on a drill bit, such as the type shown in FIG. 1, it is also intended that the cutting elements may be used on other types of downhole tools, including for example, a hole opener. FIG. 6 shows a general configuration of a hole opener 830 that includes one or more cutting elements of the present disclosure. The hole opener 830 comprises a tool body 832 and a plurality of blades 838 disposed at selected azimuthal locations about a circumference thereof. The hole opener 830 generally comprises connections 834, 836 (e.g., threaded connections) so that the hole opener 830 may be coupled to adjacent drilling tools that comprise, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A cutting element comprising:

a substrate; and a polycrystalline diamond layer on the substrate, the polycrystalline diamond layer having a non-planar working surface, the non-planar working surface being formed from a first region and a second region, the first region, encompassing at least a cutting edge or tip of the cutting element and having a differing polycrystalline diamond composition than the second region.

2. The cutting element of claim 1, wherein the first region is comprised of sintered diamond particles with an average particle size of less than about 20 μm.

3. The cutting element of claim 2, wherein the second region is comprised of sintered diamond particles with an average particle size of greater than about 20 μm.

4. The cutting element of claim 1, wherein the first region is comprised of sintered diamond particles with a magnesium carbonate binder.

5. The cutting element of claim 4, wherein the magnesium carbonate binder is less than about 3 percent by volume of the polycrystalline diamond layer.

6. The cutting element of claim 4, wherein the second region is comprised of sintered diamond particles with a calcium carbonate binder.

7. The cutting element of claim 6, wherein the calcium carbonate binder is more than about 3 percent by volume of the polycrystalline diamond layer.

8. The cutting element of claim 1, wherein the first region is a polycrystalline diamond material that is substantially free of a Group VIII metal in interstitial regions between bonded together diamond grains of the polycrystalline diamond.

9. The cutting element of claim 8, wherein the second region is a polycrystalline diamond material having bonded together diamond grains and a plurality of interstitial regions between the bonded together diamond grains, the plurality of interstitial regions having a Group VIII metal therein.

10. The cutting element of claim 1, wherein the first region is at least about 50 percent more wear resistant than the second region.

11. The cutting element of claim 1, the polycrystalline diamond layer further comprising:

a crest extending along at least a portion of the diameter of the cutting element, wherein an uppermost point of the crest has a radius of curvature that transitions to sidewall surface portions of the working surface, the sidewall surface portions having a reduced height extending laterally away from the crest.

12. The cutting element of claim 1, the polycrystalline diamond layer further comprising:

a conical shaped working surface.

13. A method for making a cutting element comprising:

assembling two distinct material compositions into a sintering container for forming an ultrahard layer with a non-planar working surface, the two distinct material compositions comprising:

a first material positioned in the sintering container at a location corresponding to a cutting edge or tip of the ultrahard layer; and a second powdered material mixture positioned in physical contact with the first material, the second powdered material mixture having a different composition than the first material;

subjecting the two distinct material compositions to a high temperature high pressure processing condition to form the ultrahard layer, wherein the first material forms a first region of the ultrahard layer, and the second powdered material mixture forms a second region of the ultrahard layer; and attaching a substrate to the ultrahard layer by high temperature high pressure processing.

14. The method of claim 13, wherein the first material is a first powdered material mixture.

15. The method of claim 14, wherein the first powdered material mixture includes diamond particles with an average particle size of less than about 20 μm.

16. The method of claim 15, wherein the second powdered material mixture includes diamond particles with an average particle size of greater than about 20 μm.

17. The method of claim 14, wherein the first powdered material mixture includes less than about 3 percent by volume of magnesium carbonate.

18. The method of claim 17, wherein the second powdered material mixture includes greater than about 3 percent by volume calcium carbonate.

19. The method of claim 13, wherein the first material is subjected to a separate high temperature high pressure processing condition prior to assembling the second powdered material mixture.

20. The method of claim 13, wherein the substrate is attached to the ultrahard layer by the high temperature high pressure processing condition.

21. A downhole cutting tool, comprising:

a tool body; and at least one cutting element attached to the tool body, wherein the at least one cutting element comprises a substrate and an ultrahard layer on the substrate, the ultrahard layer having a non-planar working surface, the non-planar working surface being formed from a first region and a second region, the first region, encompassing at least a cutting edge or tip of the at least one cutting element and having a differing composition than the second region, and wherein the first region is separated from the substrate by the second region.

* * * * *